US010573287B2

(12) United States Patent
Smith

(10) Patent No.: US 10,573,287 B2
(45) Date of Patent: Feb. 25, 2020

(54) FOUR-PEDAL BASS KEYBOARD

(71) Applicant: Gregory Clifford Smith, Mineola, TX (US)

(72) Inventor: Gregory Clifford Smith, Mineola, TX (US)

( * ) Notice: Subject to any disclaimer, the term of this patent is extended or adjusted under 35 U.S.C. 154(b) by 0 days.

(21) Appl. No.: 16/028,744

(22) Filed: Jul. 6, 2018

(65) Prior Publication Data

US 2020/0013382 A1 Jan. 9, 2020

(51) Int. Cl.

| | |
|---|---|
| ***G10H 1/34*** | (2006.01) |
| ***G10H 1/053*** | (2006.01) |
| ***G10H 1/36*** | (2006.01) |
| ***H01C 10/14*** | (2006.01) |
| ***G05G 1/445*** | (2008.04) |

(52) U.S. Cl.

CPC ..... *G10H 1/348* (2013.01); *G05G 1/445* (2013.01); *G10H 1/053* (2013.01); *G10H 1/36* (2013.01); *H01C 10/14* (2013.01); *G10H 2220/221* (2013.01)

(58) Field of Classification Search

CPC ..... G10H 1/348; G10H 1/36; G10H 1/053; G10H 2220/221; G05G 1/445; H01C 10/14

USPC ..... 84/721, 746

See application file for complete search history.

(56) References Cited

U.S. PATENT DOCUMENTS

| | | | | |
|---|---|---|---|---|
| 3,546,995 | A * | 12/1970 | Semprevivo | G10H 1/348 84/444 |
| 4,491,050 | A * | 1/1985 | Franzmann | G10C 3/14 84/746 |
| 5,091,613 | A * | 2/1992 | Rohde | G10B 3/14 200/5 A |
| 5,550,321 | A * | 8/1996 | Brann | G10H 1/348 84/721 |
| 5,786,540 | A * | 7/1998 | Westlund | G10H 1/0008 84/645 |
| 6,545,204 | B1 * | 4/2003 | Wadell | G10H 1/348 84/422.1 |
| 6,743,971 | B1 * | 6/2004 | Chen | G10H 1/32 84/746 |
| 9,111,516 | B1 * | 8/2015 | Saraceni | G10H 1/34 |
| 9,396,714 | B1 * | 7/2016 | Morong | G10H 1/348 |
| 2016/0012806 | A1 * | 1/2016 | Mori | G10D 13/006 84/746 |

* cited by examiner

*Primary Examiner* — Jeffrey Donels

(74) *Attorney, Agent, or Firm* — Warren V. Norred; Norred Law, PLLC

(57) ABSTRACT

An electronic synthesizer instrument incorporating four bass pedals which can be played either with the heel or the toe of the foot, so as to allow the playing of all twelve notes in a chromatic octave with just the four pedals. The apparatus is an improvement upon existing bass pedal devices which enables easier playing of the bass parts for musicians simultaneously playing other instruments. The assignment of the pitch to the pedals is selectable, but two of the easiest-to-play embodiments are described in detail. The four pedals rock on a central pivot, each giving two distinct notes. Half pitches between notes addressed by adjacent pedals can be accessed by holding both adjacent pedals down.

6 Claims, 8 Drawing Sheets

FIG. 4

| Pedal | 1 | 1 & 2 | 2 | 2 & 3 | 3 | 3 & 4 | 4 |
|---|---|---|---|---|---|---|---|
| Toe | B♭ | B | C | C# | D | E♭ | E |
| Heel | F | F# | G | A♭ | A | B♭ | B |

KEY OF C

| Pedal | 1 | 1 & 2 | 2 | 2 & 3 | 3 | 3 & 4 | 4 |
|---|---|---|---|---|---|---|---|
| Toe | C | C# | D | D# | E | F | F# |
| Heel | G | G# | A | A# | B | C | C# |

KEY OF D

| Pedal | 1 | 1 & 2 | 2 | 2 & 3 | 3 | 3 & 4 | 4 |
|---|---|---|---|---|---|---|---|
| Toe | D | D# | E | F | F# | G | G# |
| Heel | A | A# | B | C | C# | D | D# |

KEY OF E

| Pedal | 1 | 1 & 2 | 2 | 2 & 3 | 3 | 3 & 4 | 4 |
|---|---|---|---|---|---|---|---|
| Toe | E♭ | E | F | G♭ | G | A♭ | A |
| Heel | B♭ | B | C | D♭ | D | E♭ | E |

KEY OF F

| Pedal | 1 | 1 & 2 | 2 | 2 & 3 | 3 | 3 & 4 | 4 |
|---|---|---|---|---|---|---|---|
| Toe | F | F# | G | G# | A | A# | B |
| Heel | C | C# | D | D# | E | F | F# |

KEY OF G

FIG. 5

| Pedal | 1 | 1 & 2 | 2 | 2 & 3 | 3 | 3 & 4 | 4 |
|---|---|---|---|---|---|---|---|
| Toe | F | F# | G | A♭ | A | B♭ | B |
| Heel | B♭ | B | C | C# | D | E♭ | E |

KEY OF C

| Pedal | 1 | 1 & 2 | 2 | 2 & 3 | 3 | 3 & 4 | 4 |
|---|---|---|---|---|---|---|---|
| Toe | G | G# | A | A# | B | C | C# |
| Heel | C | C# | D | D# | E | F | F# |

KEY OF D

| Pedal | 1 | 1 & 2 | 2 | 2 & 3 | 3 | 3 & 4 | 4 |
|---|---|---|---|---|---|---|---|
| Toe | A | A# | B | C | C# | D | D# |
| Heel | D | D# | E | F | F# | G | G# |

KEY OF E

| Pedal | 1 | 1 & 2 | 2 | 2 & 3 | 3 | 3 & 4 | 4 |
|---|---|---|---|---|---|---|---|
| Toe | B♭ | B | C | D♭ | D | E♭ | E |
| Heel | E♭ | E | F | G♭ | G | A♭ | A |

KEY OF F

| Pedal | 1 | 1 & 2 | 2 | 2 & 3 | 3 | 3 & 4 | 4 |
|---|---|---|---|---|---|---|---|
| Toe | C | C# | D | D# | E | F | F# |
| Heel | F | F# | G | G# | A | A# | B |

KEY OF G

FIG. 7

| | Song title | Artist | Songwriter |
|---|---|---|---|
| 1. | Act Naturally | Buck Owens | Johnny Russell and Voni Morrison |
| 2. | All My Exes Live in Texas | George Strait | Sanger D. Shafer and Linda J. Shafer |
| 3. | Fifteen Years Ago | Conway Twitty | Raymond Smith |
| 4. | Folsom Prison Blues | Johnny Cash | Johnny Cash |
| 5. | Heart Over Mind | Mel Tillis | Mel Tillis |
| 6. | Hello Darlin' | Conway Twitty | Conway Twitty |
| 7. | Mama Tried | Merle Haggard | Merle Haggard |
| 8. | On the Other Hand | Randy Travis | Paul Overstreet and Don Schlitz |
| 9. | Right or Wrong | Bob Wills | Arthur Sizemore and Paul Biese |
| 10. | Six Days on the Road | Dave Dudley | Earle Green and Carl Montgomery |

a.

| Song | Chord by Measure (from CowboyLyrics.com) | | | | | | | | | | | | | | |
|---|---|---|---|---|---|---|---|---|---|---|---|---|---|---|---|
| 1 | G | G | C | C | G | G | D | D | G | G | C | C | D | D | G | G |
| 2 | A | A | E | Bm | B | Bdim | A | A | A | A | E | E | A | A | | |
| 3 | D | A7 | D | D | G | D | D | G | D | G | D | A | D | D | | |
| 4 | E | E | E | E | A | A | E | E | B7 | B7 | B7 | E | E | | | |
| 5 | G | G | A | A | C | C | G | G | G | G | A | A | C | C | G | G |
| 6 | C | G | C | C7 | F | F | C | C | C | G | C | C7 | D | D | G | G |
| 7 | D | G | D | G | D | D | A | A | D | G | D | G | D | A | D | D |
| 8 | D | D | G | G | D | D | A | A | D | D | G | G | E | E7 | A | A |
| 9 | E7 | E7 | A7 | A7 | D7 | D7 | G | G | B | Bm | D | D | A | A | D | D |
| 10 | G | D | G | G | G | G | D | D | C | D | G | C | G | D | G | G |

b.

| Song | Foot Displacement by Measure - Conventional | | | | | | | | | | | | | | | |
|---|---|---|---|---|---|---|---|---|---|---|---|---|---|---|---|---|
| 1 | 0 | 0 | 3 | 0 | 3 | 0 | 4 | 0 | 4 | 0 | 3 | 0 | 1 | 0 | 4 | 0 |
| 2 | 0 | 0 | 4 | 4 | 0 | 0 | 1 | 0 | 0 | 0 | 4 | 0 | 4 | 0 | | |
| 3 | 0 | 4 | 4 | 0 | 3 | 3 | 0 | 3 | 3 | 3 | 3 | 4 | 4 | 0 | | |
| 4 | 0 | 0 | 0 | 0 | 3 | 0 | 3 | 0 | 4 | 0 | 0 | 4 | 4 | | | |
| 5 | 0 | 0 | 1 | 0 | 2 | 0 | 3 | 0 | 0 | 0 | 1 | 0 | 2 | 0 | 3 | 0 |
| 6 | 0 | 4 | 4 | 0 | 3 | 0 | 3 | 0 | 0 | 3 | 3 | 0 | 1 | 0 | 4 | 0 |
| 7 | 0 | 3 | 3 | 3 | 3 | 0 | 4 | 0 | 4 | 3 | 3 | 3 | 3 | 4 | 4 | 0 |
| 8 | 0 | 0 | 3 | 0 | 3 | 0 | 4 | 0 | 4 | 0 | 3 | 0 | 2 | 0 | 4 | 0 |
| 9 | 0 | 0 | 4 | 0 | 3 | 0 | 4 | 0 | 2 | 0 | 2 | 0 | 4 | 0 | 4 | 0 |
| 10 | 0 | 4 | 4 | 0 | 0 | 0 | 4 | 0 | 1 | 1 | 4 | 3 | 3 | 4 | 4 | 0 |

c.

| Song | Foot Displacement by Measure - Present Invention | | | | | | | | | | | | | | | |
|---|---|---|---|---|---|---|---|---|---|---|---|---|---|---|---|---|
| 1 | 0 | 0 | 1 1/2 | 0 | 1 1/2 | 0 | 1/2 | 0 | 1/2 | 0 | 1/2 | 0 | 1/2 | 0 | 1/2 | 0 |
| 2 | 0 | 0 | 1/2 | 1 1/2 | 0 | 0 | 1 | 0 | 0 | 0 | 1/2 | 0 | 1/2 | 0 | | |
| 3 | 0 | 1/2 | 1/2 | 0 | 1 1/2 | 1 1/2 | 0 | 1 1/2 | 1 1/2 | 1 1/2 | 1 1/2 | 1/2 | 1/2 | 0 | | |
| 4 | 0 | 0 | 0 | 0 | 1 1/2 | 0 | 1 1/2 | 0 | 1/2 | 0 | 0 | 1/2 | 1/2 | | | |
| 5 | 0 | 0 | 1 | 0 | 2 1/2 | 0 | 1 1/2 | 0 | 0 | 0 | 1 | 0 | 2 1/2 | 0 | 1 1/2 | 0 |
| 6 | 0 | 1/2 | 1/2 | 0 | 1 1/2 | 0 | 1 1/2 | 0 | 0 | 1/2 | 1 | 0 | 1 1/2 | 0 | 1/2 | 0 |
| 7 | 0 | 1 1/2 | 1 1/2 | 1 1/2 | 1 1/2 | 0 | 1/2 | 0 | 1/2 | 1 1/2 | 1 1/2 | 1 1/2 | 1 1/2 | 1/2 | 1/2 | |
| 8 | 0 | 0 | 1 1/2 | 0 | 1 1/2 | 0 | 1/2 | 0 | 1/2 | 0 | 1 1/2 | 0 | 2 | 0 | 1/2 | 1/2 |
| 9 | 0 | 0 | 1/2 | 0 | 1 1/2 | 0 | 1/2 | 0 | 2 | 0 | 2 1/2 | 0 | 1 1/2 | 0 | 1 1/2 | 0 |
| 10 | 0 | 1/2 | 1/2 | 0 | 0 | 0 | 1/2 | 0 | 1 | 1 | 1/2 | 1 1/2 | 1 1/2 | 1/2 | 1/2 | 0 |

d.

FIG. 8

| Song title | Artist | Songwriter | average translation, conventional | average translation, this invention |
|---|---|---|---|---|
| Act Naturally | Buck Owens | Johnny Russell and Voni Morrison | 1.38 | 0.34 |
| All My Exes Live in Texas | George Strait | Sanger D. Shafer and Linda J. Shafer | 1.21 | 0.29 |
| Fifteen Years Ago | Conway Twitty | Raymond Smith | 2.43 | 0.79 |
| Folsom Prison Blues | Johnny Cash | Johnny Cash | 1.38 | 0.35 |
| Heart Over Mind | Mel Tillis | Mel Tillis | 0.75 | 0.63 |
| Hello Darlin' | Conway Twitty | Conway Twitty | 1.56 | 0.47 |
| Mama Tried | Merle Haggard | Merle Haggard | 2.50 | 0.93 |
| On the Other Hand | Randy Travis | Paul Overstreet and Don Schlitz | 1.44 | 0.53 |
| Right or Wrong | Bob Wills | Arthur Sizemore and Paul Siese | 1.44 | 0.63 |
| Six Days on the Road | Dave Dudley | Earle Green and Carl Montgomery | 2.00 | 0.50 |
| | | overall average for the 10 songs | 1.51 | 0.54 |

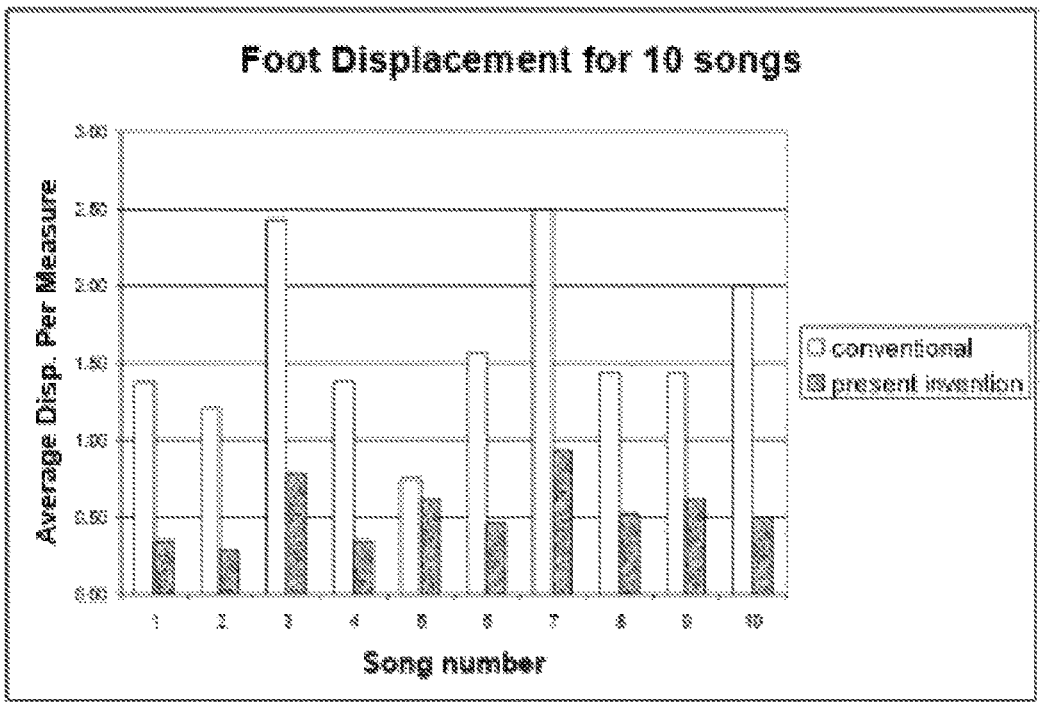

FOUR-PEDAL BASS KEYBOARD

FIELD OF THE INVENTION

The present invention relates to novel musical instruments for producing bass tones for supplementing musical performances by single musicians or very small groups. The invention disclosed herein configures the chromatic octave in a novel way so as to minimize keyboard size and make easier the playing thereof using the foot (or feet).

BACKGROUND

Musical performances by singer/songwriters and even small groups without bass players can be enhanced by a guitarist or a keyboardist adding a bass part, lower than the low string on a guitar (2nd E below middle C). Bass keyboards to be played by the feet are usually modeled after piano or organ keyboards, albeit with key spacing designed to accommodate the dimensions of the feet. See U.S. Pat. No. 4,046,049. The difficulty in playing these is that the foot must move a multiple of its width with sufficient accuracy to hit the desired note without hitting adjacent notes. This means that considerable practice must be devoted to learning the coordination to play these instruments at the same time the guitar or keyboard is being played. While it is possible to add the bass line from some form of recording, in a live performance the audiences might prefer that the performance be 'live', and not recorded. If the distances of needed foot movement could be reduced, it would be easier to learn to play the pedal board and its addition to the performance of solo guitarists and singers would be more common. The present invention allows the I-V sequence to be played by simply rocking the foot, and puts II, IV, V, VI and VII within one pedal width of the tonic I. In one of many alternative embodiments, it allows the I-IV or I-V sequence to played by rocking the foot, and puts II, IV, V, VI, and VII within one pedal width of the tonic I.

SUMMARY OF THE INVENTION

The present invention comprises a four-pedal keyboard with rocking pedals so that one of two notes can be played by depressing the pedal either with the toe or with the heel of the foot. This gives eight of the twelve notes of a chromatic octave, for example. From left to right, the pedals are separated by two chromatic steps. In this invention, depressing two adjacent pedals gives the note between the two pedals. This allows the four pedal system to play one entire octave with all twelve notes, plus two extra notes. However, in the preferred embodiment two of the notes overlap giving exactly one octave with all the chromatics, and two notes doubled within the octave. By affording this simplicity of play, it requires that the device be monophonic rather than polyphonic, which is not an issue for a bass playing device. In the preferred embodiment of this invention the toe and heel of a given pedal play note I of the scale and note V of the major scale in the next lower octave, respectively. This sequence of notes is often encountered in the bass part of many popular songs, and requires moving the foot 4 chromatic keys, or using two feet, incurring accuracy challenges when using the conventional pedal keyboard design, which is similar to a piano key layout albeit with wider key separations to accommodate playing by the feet. In the preferred embodiment of this invention the I-V sequence can be played by rocking one foot back and forth. In this and an alternative embodiment of this invention described herein, the I-IV sequence can be played by rocking one foot back and forth. A more complete popular sequence of notes is I-IV-V-I. This requires playing the tonic I, then moving the foot 7 chromatic keys down, then 2 up, then up 5 to return to the original I, when using a conventional bass keyboard. Using this invention in the preferred embodiment the same sequence requires depressing one pedal using the toe, playing the heel one key to the left, then the heel of the original pedal, then rocking back to the toe on the same pedal to go back to I, a much easier sequence to learn.

In an alternative embodiment of this invention the heel and toe of a given pedal (for example) play notes I in the scale and note V of the scale in the same octave. This arrangement affords another easy way to play the I-IV-V-I sequence of notes explained in the preferred embodiment. In this case, the heel of pedal 2 is played first (I), then the toe of pedal 1 (IV), the toe of pedal 2 (V), and again the heel of pedal 2 (I).

In the referenced invention, the switches associated with each end of the four pedals address inputs to a processing circuit board which then generates the note played. Programming this processing circuit board can produce any note layout on the keyboard, as it can conventionally. But the note layouts possible using four rocking pedals give greater ease of play than the note layouts in the conventional keyboard style used in many commercial products, including but not limited to the Roland PK-6, the 3 Keith McMillen Instruments Twelve-Step Chromatic Key Controller, the Moog Taurus 3. These instruments have a pedal for each of the eleven chromatic notes between octaves, plus two at either end of the octave. The bass player must be able to move the foot (or feet) to use all of the notes addressed in a given song, which could be moving from the left end to the right end of the instrument, with displacements which can be as large as 7 pedal widths. In the current invention, only four pedals are used, requiring lateral displacements between notes of no more than three pedal widths, thus making bass accompaniments easier to learn.

BRIEF DESCRIPTION OF THE DRAWINGS

FIG. 4 is tables of notes to be assigned to the pedals in the programming of the controller board in the preferred embodiment. Twelve tables are required to show all the note configurations for any given embodiment corresponding to the selected key being any of the twelve notes in the chromatic scale. Only five are shown in FIG. 3. The others can be easily derived by those knowledgeable in music and programmed into the controller. In the preferred embodiment the toe position of pedal 2 is defined as the keynote, although any of the eight pedal positions may be defined this way for other embodiments of the invention, as well as even the positions where two adjacent pedals are played.

FIG. 5 shows tables of notes to be assigned to the pedals in the programming of the controller board in the alternate embodiment. Twelve tables are required to show all the note configurations for any given embodiment corresponding to the selected key being any of the twelve notes in the chromatic octave. Only five are shown in FIG. 3. The others can be easily derived by those knowledgeable in music and programmed into the controller. In this alternate embodiment the heel position of pedal 2 is defined as the keynote, although any of the eight pedal positions may be defined this way for other embodiments of the invention, as well as even the positions where two adjacent pedals are played. As is seen from the tables, in the alternate embodiment the range of the instrument is two chromatic tones beyond the octave. Other undescribed embodiments are of course possible depending upon the musical needs of the player, each of which would be described by twelve tables.

FIG. 7 shows in tabular form the names of the ten country songs for which the conventional case and the invention are compared (a), the chords in the first two lines of the verse of each song (b), and the number of pedal widths of each of the transitions required in the conventional and invention cases. Rocking from toe to heel or heel to toe is regarded as one-half of a pedal width in the case of the invention.

FIG. 8 shows in tabular (a) and graphical (b) form the average foot travel required of the player of each of the ten songs chosen and shown in FIG. 7.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a", "an", and "the" are intended to include the plural forms as well as the singular forms, unless the context clearly indicates otherwise. It will be further understood that the terms "comprises" and/or "comprising", when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

A novel musical keyboard instrument played by the feet is disclosed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
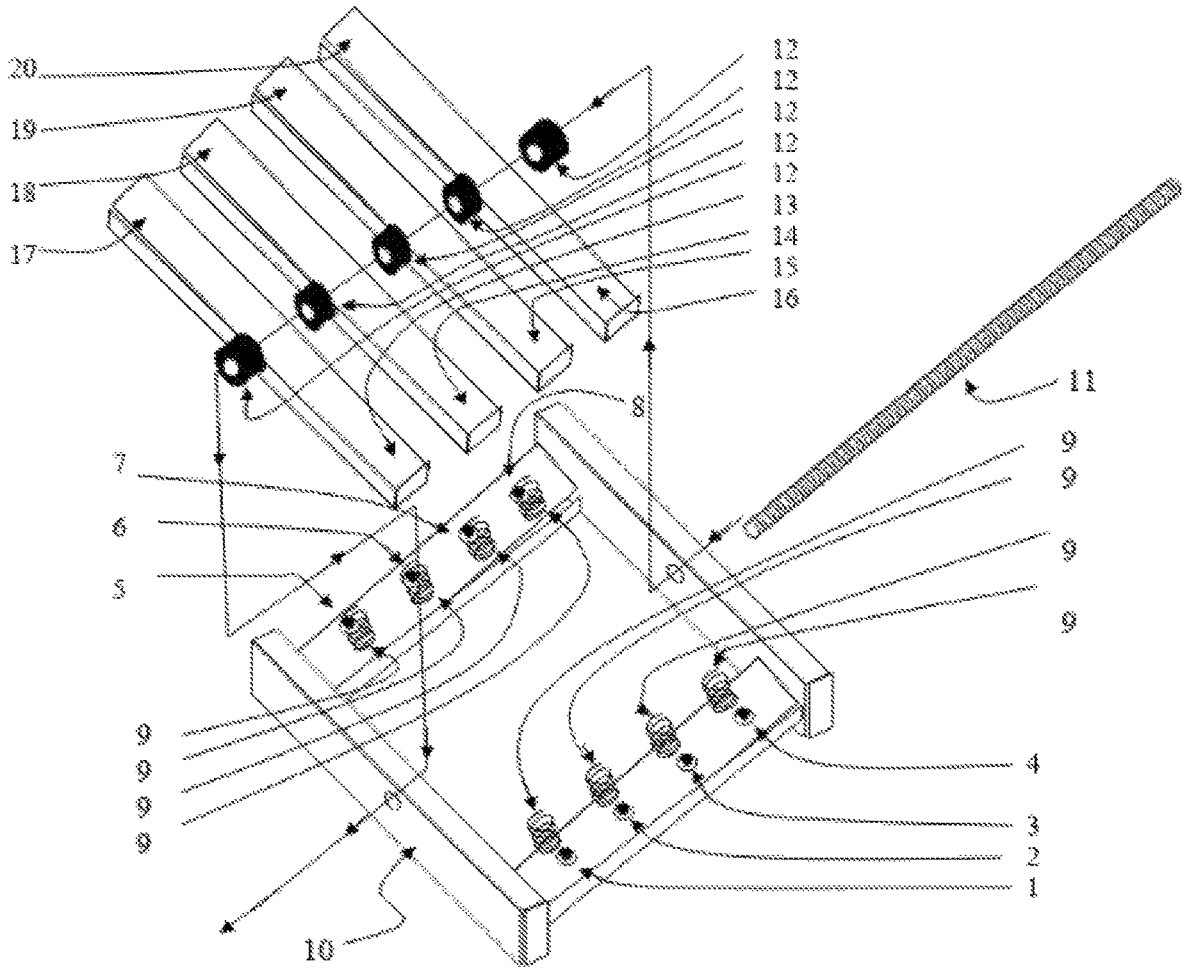
FIG. 1 is an exploded view of a four pedal bass keyboard device according to various embodiments of the present invention.

The present invention will now be described by referencing the appended figures representing preferred embodiments. FIG. 1 depicts an exploded perspective view of the elements that may comprise a four pedal keyboard device (the "device") according to various embodiments of the present invention. The mechanics of the keyboard instrument played by the feet include eight momentary switches, labeled 1 through 8, which are played either by the heel end (numbers 13, 14, 15, and 16) or the toe end (numbered 17, 18, 19, and 20) of the four-foot pedals. The pedals are suspended above the switches by a pivot rod 11 which goes through pedal spacers 12 and center holes in the pedals as shown and are held above the normally-off switches by springs 9 centered in holes in the yoke 12 which holds the device together.

Figure 2A:
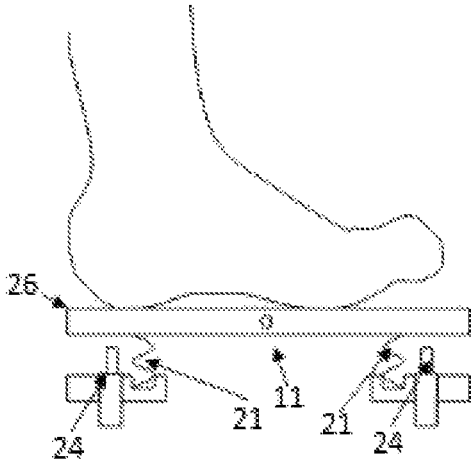
FIG. 2A is a side view of an embodiment of the invention with the pedal not played.
Figure 2B:
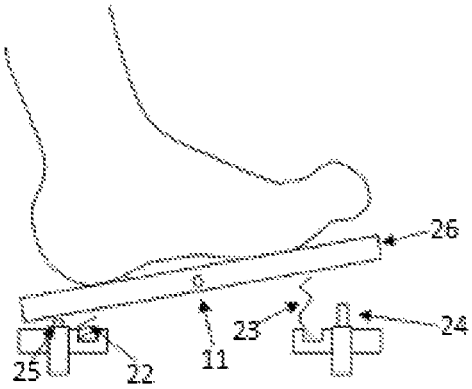
FIG. 2B is a side view of an embodiment of the invention with the pedal played with the heel.
Figure 2C:
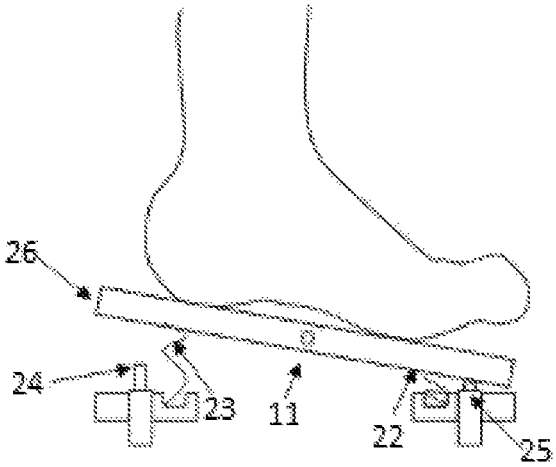
FIG. 2C is a side view of an embodiment of the invention with the pedal played with the toe.

FIG. 2 represents the device in use, albeit with the side plate of the yoke (10 in FIG. 1) removed so the operation can be seen. The pivot rod 11 is viewed along its axis. The pedal 26 is viewed in its quiescent state in 2(*a*), as playing the note assigned to its "heel" position in (b), and as playing the note assigned to its "toe" position in (c). The springs in their quiescent state are shown 21, in the compressed state corresponding to the note being played 22, and in the state where the opposite end of the pedal is depressed 23. The springs can be replaced by torsion springs about the pivot rod in other embodiments of the same invention. The unpressed switch is shown 24, and the pressed ("on" state) switch is shown 25. It is noted that no note sounds when the foot is in position represented by (a), the note corresponding to the heel end of the pedal sounds when the foot is in the position represented by (b), and the note corresponding to the toe end of the pedal sounds when the foot is in the position represented by (c).

Figure 3:
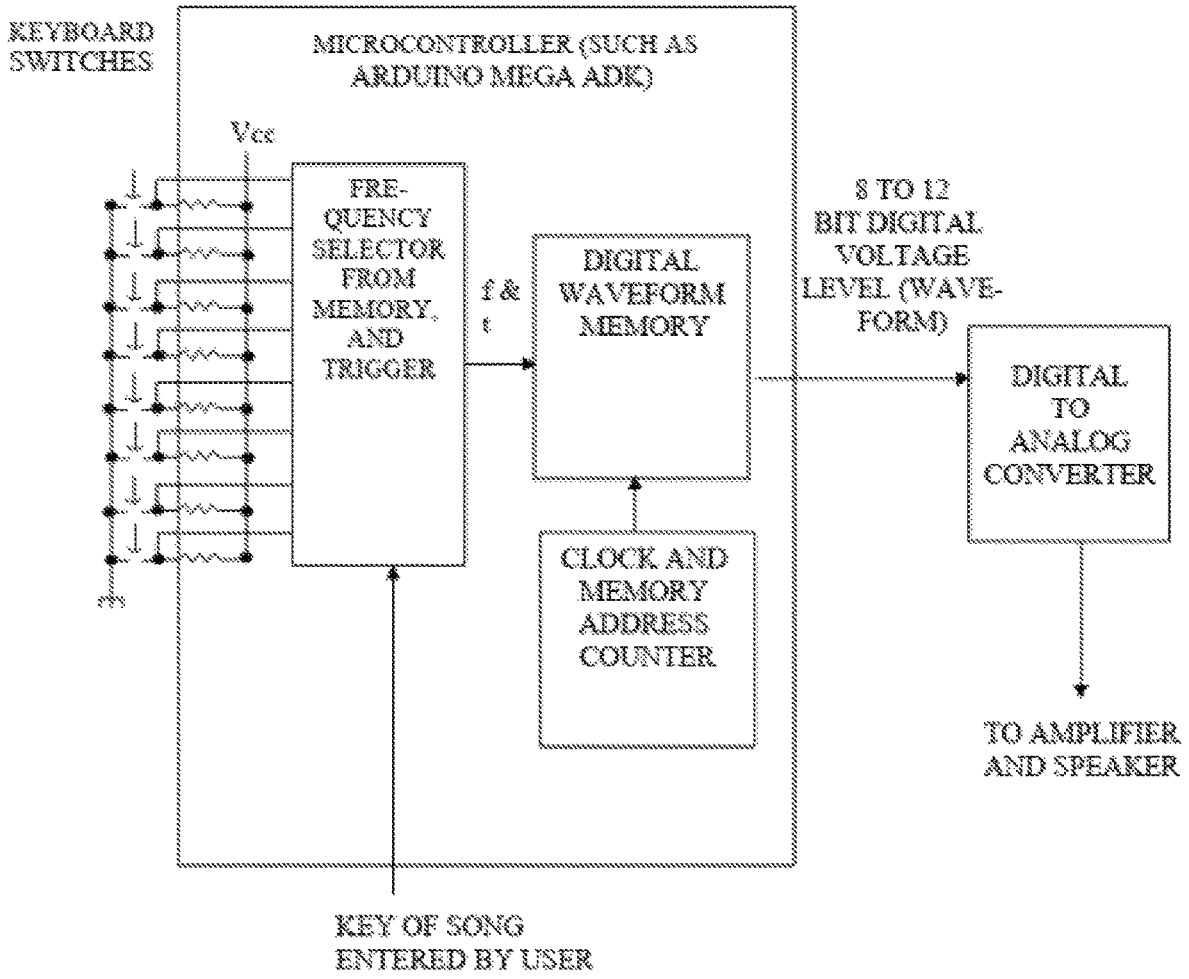
FIG. 3 is a block diagram of an embodiment of the keyboard system including the electronic circuit which delivers the tones from the pedal board. The circuit includes all programming of the notes corresponding to the pedals in either center (off) or toe or heel positions.

FIG. 3 represents a block diagram of the preferred embodiment of the four-pedal keyboard. The switches 1-4 are those which are under the heel end of the pedals, and switches 5-8 are under the toe end of the pedals. The wiring of the switches gives a ground level signal when the switch is depressed by the pedal, and a level of approximately Vcc when the switch is not depressed. The states of the switches are read by the microcontroller, and a frequency corresponding to the switch states is elected. Binary numbers corresponding to the desired voltage output at a given time are output from the microcontroller to the digital-to-analog converter (DAC) which are then converted into the analog signal which is the waveform, to be amplified and converted to sound by a speaker or a set of headphones.

FIG. 4 is a set of five tables of note assignments for the pedals in the preferred embodiment. In this embodiment, the key of the song to be played is first entered into the microcontroller. This defines the pedal layout as to which notes are to be played by the toe and heel of each pedal, and these are shown in the five tables for five of the twelve possible chromatic keys. The other tables can be derived from one of the five by anyone skilled in the art of music. In the preferred embodiment the toe end of pedal 2, as numbered from the left, is defined as the keynote as is shown in the tables. The keynote corresponding to each of the tables is shown under the table. This enables the player to play the I-IV-V sequence by moving by no more than one pedal laterally. This sequence is very common in popular music.

FIG. 5 is a set of five tables of note assignments for the pedals in an alternate embodiment. In this embodiment, the key of the song to be played is first entered into the microcontroller. This defines the pedal layout as to which notes are to be played by the toe and heel of each pedal, and these are shown in the five tables for five of the twelve possible chromatic keys. The other tables can be derived from one of the five by anyone skilled in the art of music. In this alternate embodiment the heel end of pedal 2, as numbered from the left, is defined as the keynote as is shown in the tables. The keynote corresponding to each of the tables is shown under the table. This enables the player to play the I-IV-V sequence by moving by no more than one pedal laterally. This sequence is very common in popular music.

Figure 6A:
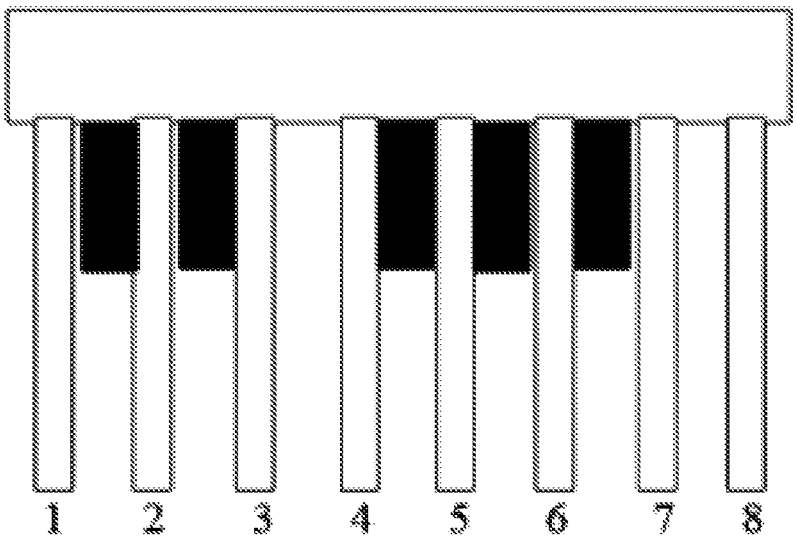
FIG. 6A shows the key layout of the conventional design.
Figure 6B:
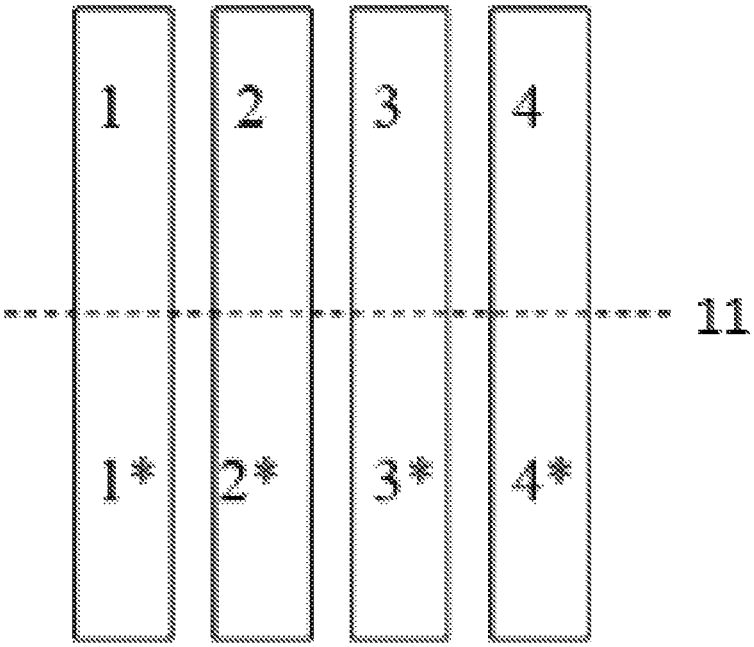
FIG. 6B shows the preferred embodiment of the novel four-pedal system first described herein.

FIG. 6 is a comparison of the layout of the conventional foot pedal board for playing bass (a), with the novel four pedal layout (b). The "white keys" are numbered in the conventional case (a). The four pedals 1-4 in the present invention (b) are those played using the toe, and the numbers with asterisks are the notes played by the heel The purpose of FIG. 6 is to define foot displacements for a comparison of the conventional and novel designs in ten songs in FIGS. 7 and 8. In the conventional case (a), moving from C to G, for example (or 1 to 5) would be a displacement of 4, if the scale were designated in software as the C scale. In the case of the present invention (b), moving from the toe to the heel of pedal 1 is defined to be equivalent to a half a displacement. So moving from the toe of pedal 1 to the heel of pedal 4 would be a displacement of 3.5.

FIG. 7 is a comparison of the difficulty of moving the foot to hit the bass notes in ten typical country music songs, identified in the figure. Shown are the bass notes of the chords in the first two lines of the first verse of each of the songs (b). Below this, the lateral foot translation required to play each song is shown for the conventional (c) and invented (d) designs.

FIG. 8 shows the average foot translation required for playing the ten songs on the conventional instrument and on the invention. The foot translation is shown on the invention to be about ⅓ that of the conventional design for the ten chosen songs, thus illustrating the advantage afforded by the novel design. It will be noted, of course, that ten songs can hardly represent the body of musical composition mankind has produced over the ages, but the ten songs are illustrative of the advantage given by the invention for thousands of songs encountered in popular culture, and the thus the need for such a design.

A legend of the components discussed in the application and shown in the drawings is as follows:

Momentary switch 1-8,
Spring 9,
Side plate 10,
Pivot rod 11,
Yoke 12,
Heel end of pedals 13-16,
Toe end of pedals 17-20,
Springs in quiescent state 21,
Springs in compressed state 22,
Springs with opposite end of the pedal compressed 23,
Unpressed switch 24,
Pressed switch 25,
Pedal 26

The inventor claims:

1. A four-pedal keyboard monophonic musical instrument incorporating an improved note layout, comprising:

a. Four hinged adjacent rocking pedals fixed together to a base, each pedal further comprising toe end and a heel end, the instrument further comprising a means for playing a musical note when either end is pressed; and b. Each pedal end playing a note that is two chromatic steps higher than the note played when pressing the pedal to its left on the same pedal end; and c. When two adjacent pedal ends are pressed simultaneously, the instrument includes a means for playing the note between the notes played when pressing either of said adjacent pedal ends solely, and does not play either of the two notes that each pedal plays when pressed singly.

2. The instrument described in claim 1, in which the note played by pressing one end of each pedal differs from the note played by pressing the other end of the pedal by five chromatic steps.

3. The instrument described in claim 1, in which the note played by pressing one end of each pedal differs from the note played by pressing the other end of the pedal by seven chromatic steps.

4. The instrument described in claim 1 in which the notes played by either end of the four pedals are user-assignable.

5. A four-pedal keyboard monophonic musical instrument described in claim 2, further comprising a microcontroller which generates or selects the notes from a user-programmed memory.

6. The instrument described in claim 2, further comprising spacers of varying widths to adjust pedal spacing.

* * * * *